US005596980A

United States Patent [19]

Whalen et al.

[11] Patent Number: 5,596,980

[45] Date of Patent: Jan. 28, 1997

[54] PORTABLE FIREPLACE

[75] Inventors: Bernard F. Whalen, Wacoub; Paul Doubet, Farmington, both of Ill.

[73] Assignee: Yetter Manufacturing Company, Colchester, Ill.

[21] Appl. No.: 371,298

[22] Filed: Jan. 11, 1995

[51] Int. Cl.[6] ..... F24B 1/181

[52] U.S. Cl. ..... 126/519; 126/548

[58] Field of Search ..... 126/519, 547–551, 126/190, 30, 193, 9 R, 200, 224, 222, 223, 25 R; 110/240, 241, 242

[56] References Cited

U.S. PATENT DOCUMENTS

| | | | |
|---|---|---|---|
| D. 200,137 | 1/1965 | Hanna . | |
| D. 284,929 | 8/1986 | Schlosser et al. . | |
| D. 293,191 | 12/1987 | Stephen et al. . | |
| 920,312 | 5/1909 | Fox | 110/241 |
| 3,220,400 | 11/1965 | Yager | 126/550 |
| 3,499,432 | 3/1970 | Hannebaum | 126/519 |
| 3,809,058 | 5/1974 | Becker | 126/547 |
| 3,981,292 | 9/1976 | Lilly et al. . | |
| 4,112,913 | 9/1978 | Shimek et al. | 126/519 |
| 4,181,117 | 1/1980 | Hannebaum | 126/519 |
| 4,196,714 | 4/1980 | Fromman | 126/519 |
| 4,216,760 | 8/1980 | Wiggins | 126/548 |
| 4,273,096 | 6/1981 | Hannebaum . | |
| 4,332,235 | 6/1982 | Hannebaum . | |
| 4,498,452 | 2/1985 | Schlosser et al. . | |
| 4,706,817 | 11/1987 | Greathouse | 126/25 R |
| 5,421,321 | 6/1995 | Ward | 126/519 |

*Primary Examiner*—James C. Yeung

*Attorney, Agent, or Firm*—Lee, Mann, Smith, McWilliams, Sweeney & Ohlson

[57] ABSTRACT

A portable fireplace for burning combustible materials including a base member defining a fire chamber adapted to receive and contain the materials to be burned. One or more screen members are adapted to extend upwardly from the base member and to protect against burning embers being expelled from the fireplace. A cover member is supported above the screen members and is removable to provide access to the fire chamber when desired. A support structure is associated with the base member to support the base member at a sufficient height above a support surface to prevent the burning or scorching of the support surface. One or more of the screen members is selectively removable to provide access to the fire for enhanced viewing or cooking.

25 Claims, 4 Drawing Sheets

PORTABLE FIREPLACE

BACKGROUND OF THE INVENTION

The present invention relates to portable fireplaces designed to be used primarily outdoors and, in particular, to portable fireplaces which are designed to restrict burning embers and other debris from being expelled from the fireplace.

Portable fireplaces enable users to take a fireplace to substantially any outdoor location. Portable fireplaces may be used on patios or decks, in backyards, at campsites, or when tailgating, and may be easily transported from one location to another. Portable fireplaces generally burn combustible materials such as wood or pressed wood logs. Prior portable fireplaces such as that shown in U.S. Design Pat. No. D293,191 include a generally open fire chamber which provides unrestricted view of the fire but which allows burning embers and ashes to escape from the fireplace creating a potential hazard. The present invention provides a portable outdoor fireplace designed to contain sparks, ashes and embers within the fireplace while still allowing a view of the fire and, when desired, selective access to the fire.

SUMMARY OF THE INVENTION

A portable outdoor fireplace is provided which includes a bowl-shaped base member having a circular peripheral rim. The base member defines a fire chamber adapted to receive and contain combustible materials for burning. A screen support member is positioned on top of the base member. The screen support member includes a circular base, which extends generally adjacent to and along the rim of the base member, and a plurality of vertical strut members, each of which extend generally upwardly from the base of the screen support member to an upper end. One or more screen members extend upwardly from the base member to restrict burning embers, ashes and other debris from being expelled from the fire chamber. The screen members are removably held in position by the base of the screen support member and by a plurality of screen guides attached to the strut members. A cover member is supported by the upper ends of the strut members above the screen members. The cover member is removable to provide access to the fire chamber when desired. A support structure comprising a plurality of legs is associated with the base member. The support structure supports the base member at a sufficient height above the support surface on which the fireplace rests to prevent burning or scorching thereof. At least one of the screen members is selectively removable to provide access to the fire chamber to provide for enhanced viewing or tending of the fire, or for cooking.

DESCRIPTION OF THE PREFERRED EMBODIMENT

Figure 2:
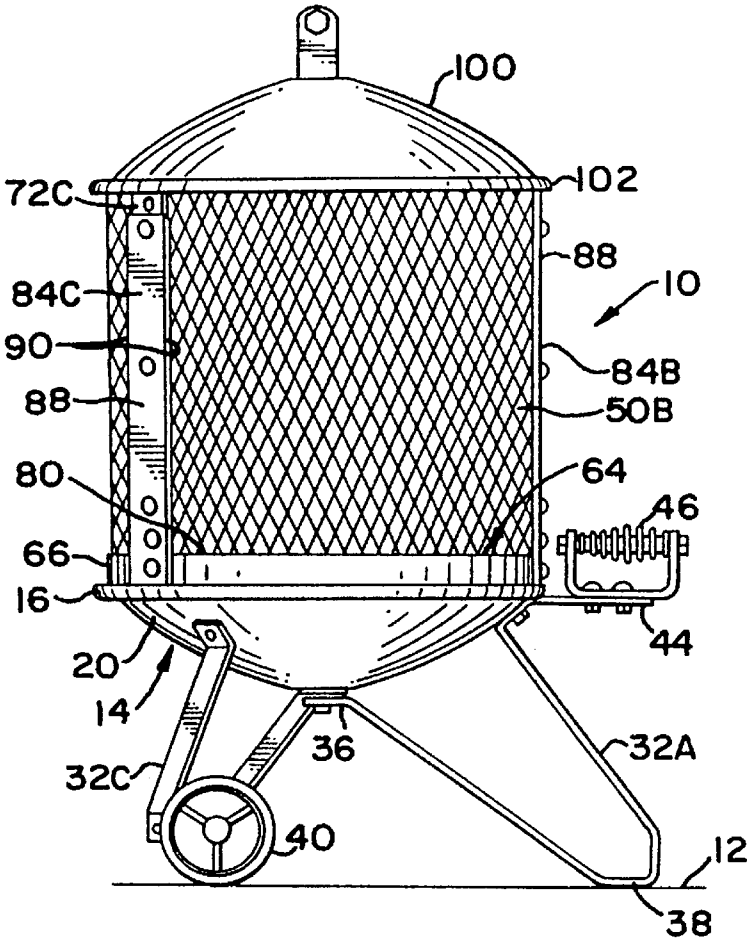
FIG. 2 is a left side elevational view of the portable fireplace.
Figure 1:
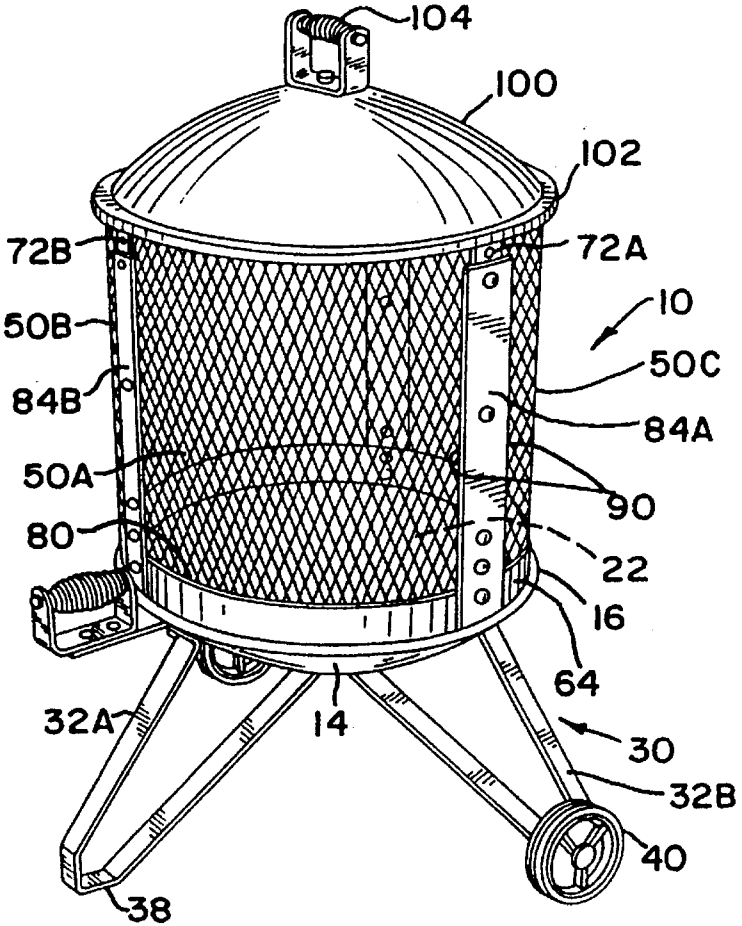
FIG. 1 is a perspective view of a portable fireplace embodying the present invention.
Figure 4:
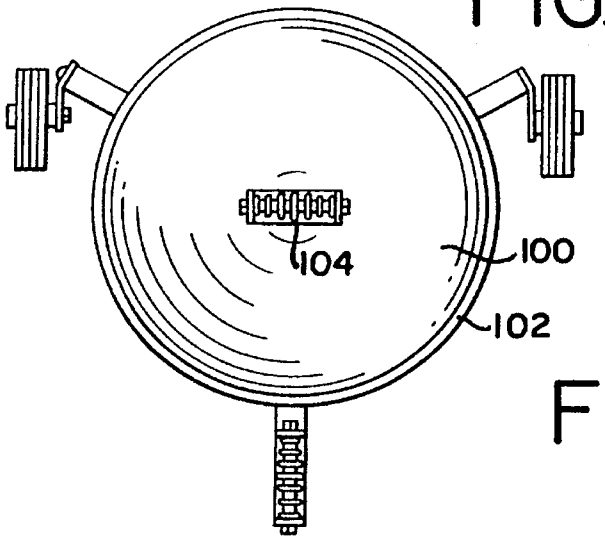
FIG. 4 is a top plan view of the portable fireplace.
Figure 8:
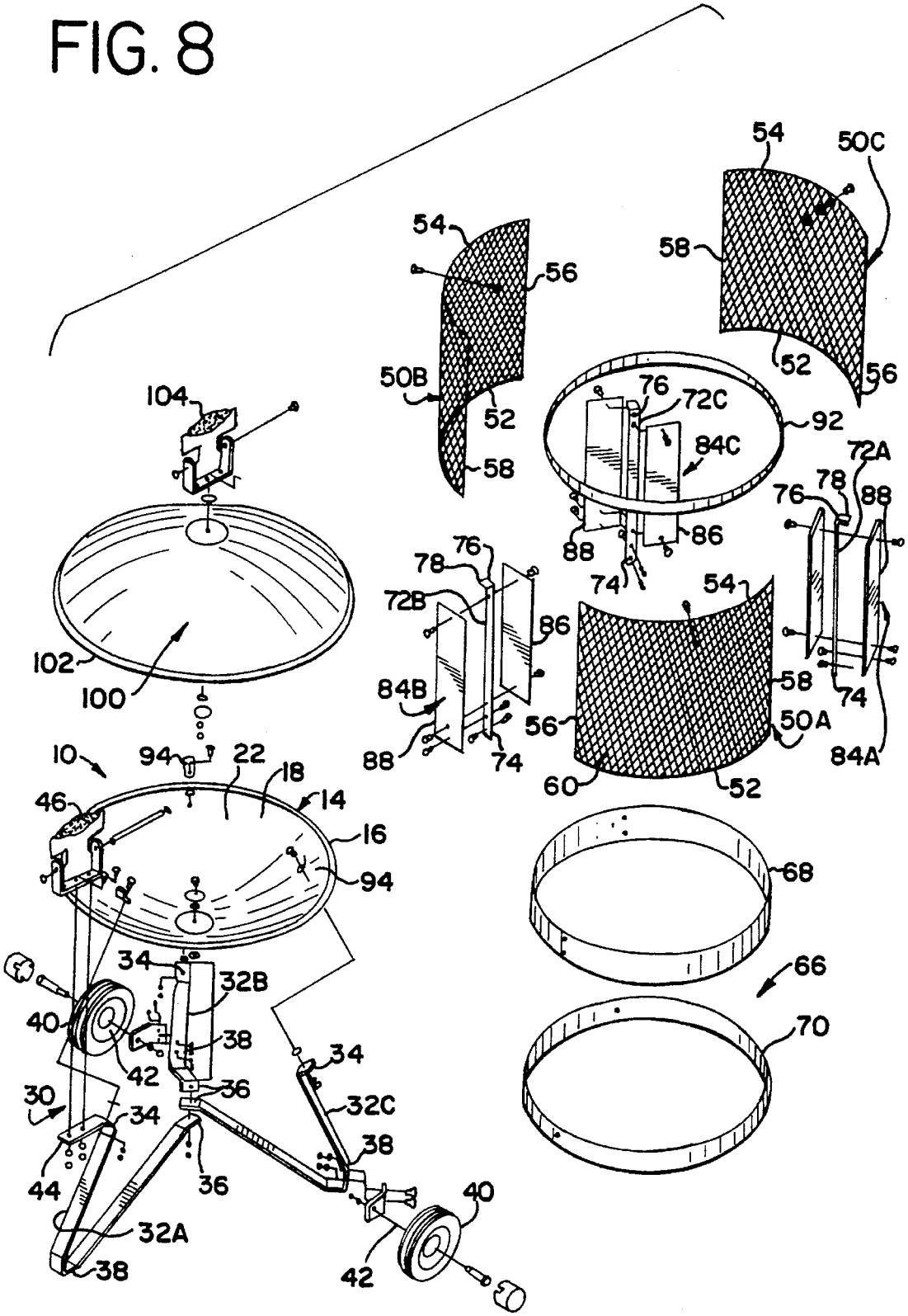
FIG. 8 is an exploded view of the portable fireplace.

The preferred embodiment of the portable fireplace 10 of the present invention is adapted to be selectively rolled along a support surface 12 such as the ground, concrete or stone patios, or wooden decks. The fireplace 10, as best shown in FIGS. 2 and 8, includes a generally hemispherical or bowl-shaped base member 14 having a circular peripheral rim 16. The base member 14 includes a generally concave interior surface 18 and a generally convex exterior surface 20. The interior surface 18 defines a fire chamber 22 adapted to receive and contain combustible materials such as wood or pressed wood logs which are to be burned. The base member 14 is preferably made of metal and is substantially non-perforate except for several small apertures which are adapted to receive and be generally sealed by fasteners. The base member 14 may alternatively be formed in a box-like shape having a bottom and four upstanding walls, or in other shapes as desired, as the shape of the bottom member is not critical to the usefulness of the invention.

Figure 5:
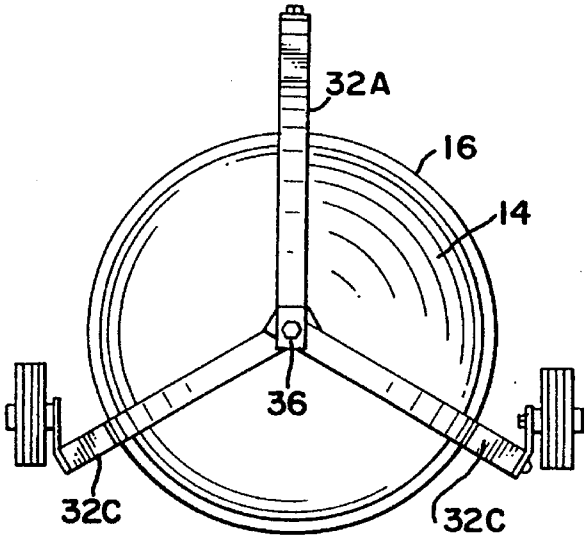
FIG. 5 is a bottom view of the portable fireplace.
Figure 3:
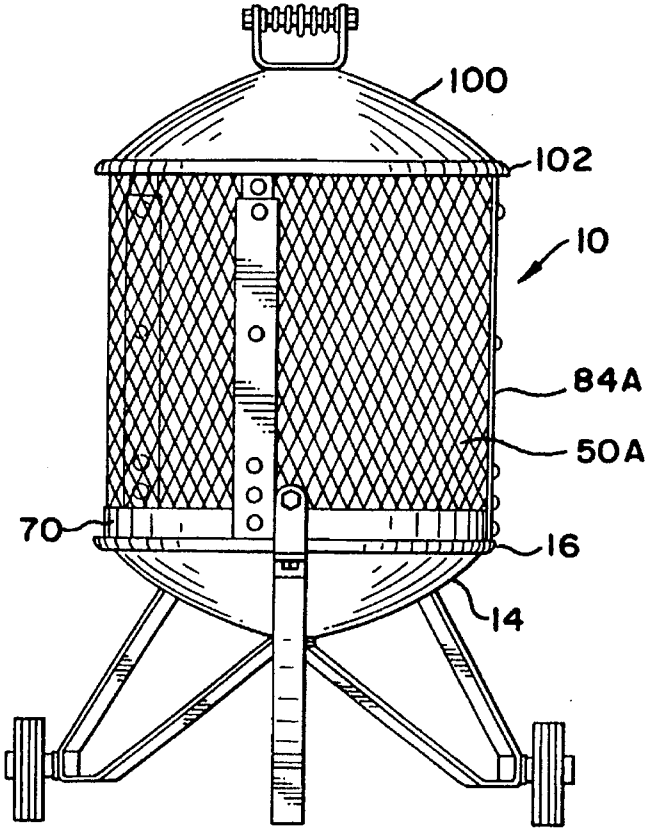
FIG. 3 is a front elevational view of the portable fireplace.
Figure 7:
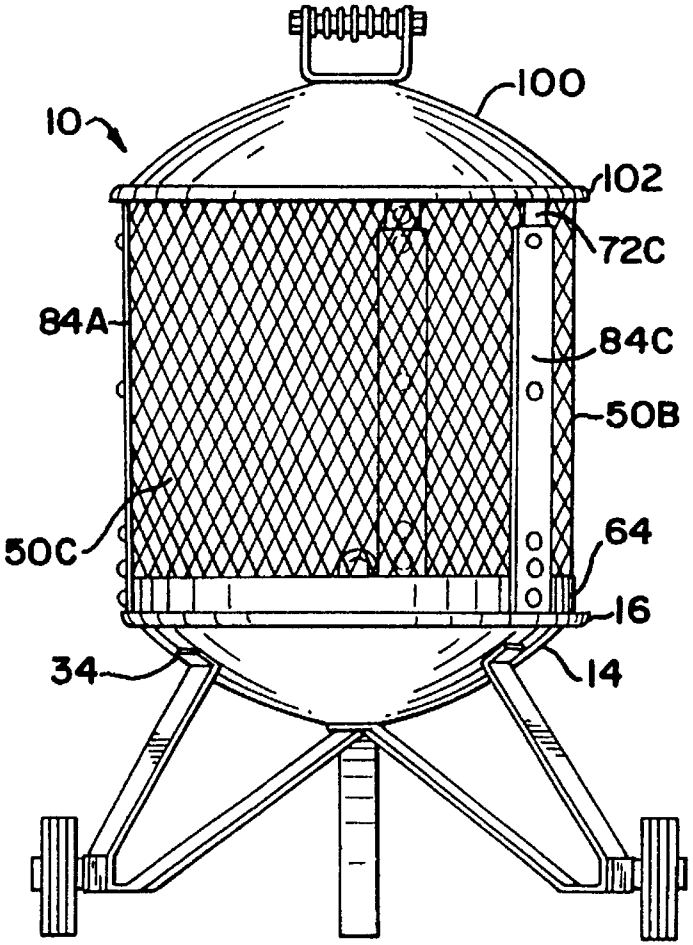
FIG. 7 is a rear elevational view of the portable fireplace.
Figure 6:
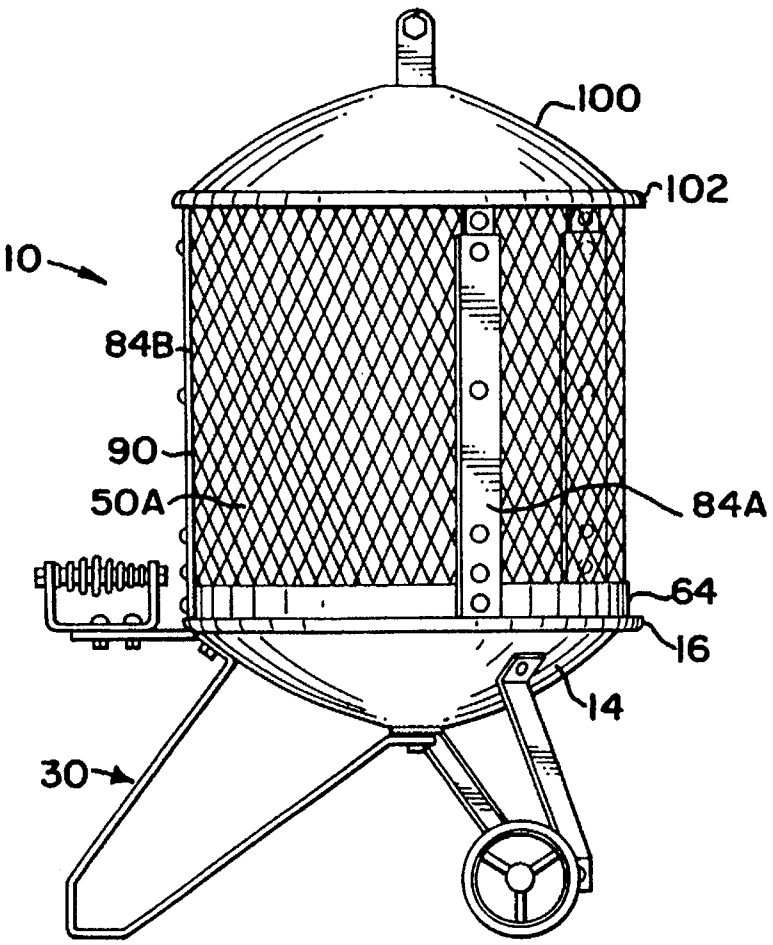
FIG. 6 is a right side elevational view of the portable fireplace.

A support structure 30 is connected to the exterior surface 20 of the base member 14 to support the base member 14 at a sufficient height above the support surface 12 to prevent the burning, scorching or otherwise overheating of the support surface 12. The support structure 30 of the preferred embodiment comprises a first leg 32A, a second leg 32B, and a third leg 32C. The support structure 30 may include fewer or additional legs if desired or may be some solid support structure of a different configuration. Each leg 32A–C is generally V-shaped and includes a first end 34, a second end 36 and a foot portion 38 located therebetween. The first end 34 of each leg 32A–C is attached to the exterior surface 20 of the base member 14 near the rim 16. The second end 36 of each leg 32A–C is attached to the exterior surface 20 of the base member 14 near the center of the base member 14. The feet 38 of the legs 32A–C are substantially equally spaced from one another as best shown in FIG. 5 to provide stable support to the base member 14. A pair of wheels 40 are respectively rotatably attached to the second leg 32B and to the third leg 32C. Each wheel 40 rotates about a substantially common axis 42. Other types of support structures 30 which are well known in the art, such as a pedestal, may be used in place of the legs 32A–C to provide a stable support for the base member 14 while providing selective rolling movement of the fireplace 10. It is also within the purview of the present invention to utilize a support structure with only a single wheel or with more than two wheels or with no wheels at all or with casters.

The first leg 32A additionally includes a bracket portion 44 which extends outwardly from the first end 34 of the first leg 32A away from the base member 14 and beyond the rim 16. A handle 46 is attached to the bracket portion 44 to provide for the manual grasping and lifting of the foot 38 of the first leg 32A off of the support surface 12 and to provide rolling movement of the fireplace 10 on the wheels 40 along the support surface 12. The handle 46 may be of many different types which are designed to insulate the hand of the user from the heat which is generated by the burning materials within the fire chamber 22. The handle 46 illustrated in FIG. 2 consists of a coil spring of frusto-conical shape disposed over a bolt which is secured by a nut. The spring member has no direct contact with the fire chamber and may be comfortably grasped by the user.

The preferred embodiment of the fireplace 10 additionally includes three screen members 50A–C. Each screen member 50A–C is generally rectangular and is curved about a vertical axis such that each screen member 50A–C includes a curved bottom edge 52, a curved top edge 54, a linear first side edge 56 and a linear second side edge 58. Each screen member 50A–C includes a plurality of apertures 60. The number and the size of the apertures 60 in each screen member 50A–C may be varied as desired, but should preferably be sufficiently small to protect against embers and other debris in the fire chamber 22 from passing therethrough. The screen members 50A–C are preferably made of expanded metal but may be of any screening material. The fireplace 10 may include fewer or additional screen members 50A–C if desired, and one or more of the screen members 50A–C may comprise a substantially non-perforate sheet of metal, plastic or glass if desired. In addition, the screen members could be planar, or of various other shapes than rectangular, if desired.

The fireplace 10 also includes a screen support member 64 adapted to removably receive and retain the screen members 50A–C in their desired position. The screen support member 64 includes a generally circular base 66 comprising an inner circular ring 68 disposed concentrically within a generally circular outer ring 70. The inner ring 68 is spaced apart from the outer ring 70 by three upstanding strut members 72A–C. Each strut member 72A–C includes a lower end 74 and an upper end 76 which includes an outwardly extending lip 78. The struts 72A–C are spaced equidistantly around the base 66 with the lower end 74 of each strut member 72A–C being inserted between and connected to the inner ring 68 and outer ring 70. The circular base 66 includes three curved elongate open channels 80 formed between the inner ring 68 and the outer ring 70. Each channel 80 extends between a pair of adjacent strut members 72A–C. Each channel 80 is adapted to removably receive the bottom edge 52 of a respective screen member 50A–C therein.

The screen support member 64 also includes three vertical screen guides 84A–C. Each screen guide 84A–C includes an inner retaining member 86 which is attached to and extends along the interior side of a respective strut member 72A–C and an outer retaining member 88 which is attached to and extends along the exterior side of the same strut member 72A–C such that the retaining members 86 and 88 are spaced apart from one another. Each screen guide 84A–C includes two generally linear elongate open channels 90 formed between the retaining members 86 and 88, one channel 90 being disposed on each lateral side of the strut member 72A–C. The channels 90 are adapted to slidably receive and retain the first side edge 56 or the second side edge 58 of the screen members 50A–C and to allow the screen members 50A–C to be slidably removed from the screen guides 84A–C when desired. The fireplace 10 may include fewer or additional strut members 72A–C and screen guides 84A–C as desired. A generally circular brace member 92 is attached to the interior side of each strut member 72A–C at its upper end 76.

The circular base 66 of the screen support member 64 rests upon the interior surface 18 of the base member 14 and extends adjacent to and along the rim 16 of the base member 14. A plurality of clip members 94 are attached to the interior surface 18 of the base member 14 to prevent sliding of the screen support member 64 while permitting the screen support member 64 to be removed from the base member 14 by lifting the support member 64 vertically. The screen support member 64 is selectively removable as a unit from the base member 14 with the screen members 50A–C. The circular base 66 of the screen support member 64 may be formed in various other shapes as desired, but should preferably be of a shape which generally follows the rim 16 of the base member 14.

The fireplace 10 also includes a generally hemispherical or bowl-shaped cover member 100 having a generally circular peripheral rim 102. A handle 104 of the same type as the handle 46 is attached to the center of the outside surface of the cover member 100. The cover member 100 is adapted to rest upon and be supported by the lips 78 of the strut members 72A–C of the screen support member 64 and to extend over the brace 90 and the top edges 54 of the screen members 50A–C. The cover member 100 may be formed in various other shapes as desired.

Each screen member 50A–C extends between a respective pair of adjacent screen guides 84A–C such that the screen members 50A–C, in conjunction with the screen guides 84A–C, form a generally cylindrical wall which extends upwardly from the base member 14 and which extends adjacent to and along the rim 16 of the base member 14. Each screen member 50A–C extends upwardly from the base member 14 to the brace member 92 of the screen support member 64 and closely adjacent to the cover member 100. The base member 14, screen members 50A–C, and the cover member 100 substantially enclose the fire chamber 22 to protect against ashes, embers or other debris from being expelled from the fire chamber 22. The rim 102 of the cover member 100 is adapted to mate with the rim 16 of the base member 14 when the screen support member 64 and the screen members 50A–C are removed from the base member 14, such that when the cover member 100 is placed on the base member 14, the base member 14 and the cover member 100 substantially enclose the fire chamber 22.

In operation, the cover member 100 and the screen support member 64 with screens 50A–C are removed to provide access to the fire chamber 22. Wood or other combustible materials may be placed on the interior surface 18 of the base member 14 within the fire chamber 22. The combustible materials may then be lighted. Once the combustible materials are lit and are burning, the screen support member 64 with screens 50A–C and the cover member 100 may be replaced.

If desired, one or more of the screen members 50A–C may be removed from the screen support member 64 and the cover member 100 may then be replaced to provide access to the fire chamber 22 during use. The opening provided by the removed screen member 50A–C will provide temporary access to the burning materials in the fire chamber 22 to allow for tending of the fire, including the addition of more wood or other materials for burning, for enhanced viewing of the fire, or for cooking food such as hot dogs, marshmallows and the like. After the necessary access has been gained, the removed screen should be replaced for safety. Alternatively, the screen members may be left in place and the cover member 100 removed for access to the fire.

When each of the screen members 50A–C are perforated, the fireplace 10 will radiate heat from the fire chamber 22 in all directions. In some conditions, such as when the fireplace 10 may be placed closely adjacent to a structure such as the side of a house, it may be desirable to replace one or more of the perforated screen members 50A–C with a non-perforated screen member to shield the adjacent structure from the heat of the burning materials.

When it is desired to extinguish the burning materials within the fire chamber 22, the cover member 100 and the screen support member 64, including the screen members 50A–C, may be lifted and removed from the base member 14. The cover member 100 may then be placed directly on the base member 14 with the rim 102 of the cover member 100 mating with the rim 16 of the base member 14. The base member 14 and the cover member 100 substantially enclose the fire chamber 22 thereby substantially cutting off oxygen to the fire chamber 22 to smother the fire. Once the fire is safely extinguished, the cover member 100 may be removed to allow for the disposal of ashes, embers and other debris that may be contained in the base member 14.

The fireplace 10 may be rolled along the support surface 12 from place to place by grasping the handle 46 and lifting upwardly to lift the foot 38 of the first leg 32A off of the support surface 12 and then rolling the fireplace on the wheels 40 to the new desired location.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A portable fireplace adapted for outdoor use and ease of transport including:

a base member defining a fire chamber adapted to receive and contain materials to be burned;

one or more screen members supported by and extending upwardly from said base member, each said screen member adapted to prevent burning embers from being expelled from said portable fireplace;

a cover member supported above said screen members and spaced above said base member, said cover member being selectively removable from said screen members so as to provide access to said fire chamber when desired;

a screen support member adapted to be positioned on said base member and extending upwardly therefrom for supporting said screen members, at least one screen member being removably supported by said screen support member, said screen support member adapted to support said cover member above said screen members; and a support structure extending downwardly from said base member adapted to support said base member at a sufficient height above a support surface on which it rests to prevent the burning or scorching of the support surface.

2. The portable fireplace of claim 1 wherein said screen support member includes a plurality of screen guide members, each said screen member being disposed between two adjacent screen guide members.

3. The portable fireplace of claim 2 wherein each said screen member includes a plurality of side edges and each said screen guide member includes a first open elongate channel adapted to removably receive a side edge of a first screen member.

4. The portable fireplace of claim 3 wherein each said screen guide member includes a second open elongate channel adapted to removably receive a side edge of a second screen member.

5. The portable fireplace of claim 4 wherein each said screen member includes a bottom edge and said screen support member includes a base including a plurality of open channels, each said open channel of said base being adapted to removable receive a bottom edge of a respective screen member.

6. The portable fireplace of claim 4 wherein said screen support member includes a base adapted to sit upon said base member and a plurality of struts extending upwardly from said base of said screen support member.

7. The portable fireplace of claim 4 wherein each said screen guide member comprises an inner retaining member and a spaced apart outer retaining member.

8. The portable fireplace of claim 1 wherein said screen support member comprises a plurality of struts supported by and extending upwardly from said base member, said struts adapted to support said cover member.

9. The portable fireplace of claim 1 wherein said screen support member includes a generally circular base adapted to sit upon said base member and a plurality of struts extending upwardly from said base of said support member, said cover member being supported by said struts.

10. The portable fireplace of claim 9 wherein said base of said screen support member includes an outer ring and an inner ring disposed within said outer ring.

11. A portable fireplace for burning combustible materials adapted for outdoor use and ease of transport including:

a base member having a peripheral rim, said base member adapted to support the combustible materials and to define a fire chamber;

a support structure depending downwardly from said base member, said support structure supporting said base member above a support surface;

a removable screen having a bottom edge, a first side edge and a second side edge extending upwardly from said base member;

a screen support member extending upwardly from said base member including a plurality of screen guide members adapted to removably receive said screen member, said screen support member including an upper end; and a cover supported by said upper end of said screen support member above said screen, said cover being selectively removable from said screen to provide selective access to said fire chamber when desired;

whereby said screen is adapted to protect against burning embers being expelled from said fire chamber and to be selectively removable from said screen support member to permit access to said fire chamber.

12. The portable fireplace of claim 11 wherein said screen support member includes a base adapted to extend adjacent to and along said rim of said base member and a plurality of strut members extending upwardly from said base, said screen guide members being attached to said strut members, each said strut member including an upper end.

13. The portable fireplace of claim 12 including a generally circular brace attached to said upper ends of said strut members.

14. The portable fireplace of claim 12 wherein said base of said screen support member includes an open elongate channel adapted to removably receive said bottom edge of said screen.

15. The portable fireplace of claim 14 wherein said base of said screen support member comprises an outer ring member and an inner ring member disposed within said outer ring member, said channel being formed between said inner ring member and said outer ring member.

16. The portable fireplace of claim 11 wherein each said screen guide member includes an open elongate channel adapted to removably receive a side edge of said screen.

17. The portable fireplace of claim 16 wherein each said screen guide member comprises an inner retaining member and a spaced apart outer retaining member, said open channel being formed between said inner retaining member and said outer retaining member.

18. The portable fireplace of claim 11 wherein said support structure comprises a plurality of legs.

19. The portable fireplace of claim 18 including a first wheel and a second wheel, each said wheel being rotatably attached to a respective leg.

20. The portable fireplace of claim 11 including a plurality of removable screens, each said screen including a bottom edge, a first side edge and a second side edge.

21. The portable fireplace of claim 20 wherein each said screen guide member includes a first open elongate channel adapted to removably receive said first side edge of a first screen and a second open elongate channel adapted to removably receive said second side edge of a second screen.

22. The portable fireplace of claim 21 wherein said screen support member includes a base having a third open elongate channel, said third channel adapted to receive said bottom edge of a screen.

23. The portable fireplace of claim 20 wherein at least one said screen includes a plurality of apertures.

24. The portable fireplace of claim 20 wherein each said screen includes a plurality of apertures.

25. A portable fireplace adapted for outdoor use and ease of transport including:

a base member defining a fire chamber adapted to receive and contain materials to be burned;

one or more screen members supported by and extending upwardly from said base member, one or more of said screen members being selectively removable from said base member to provide selective access to said fire chamber, said screen members adapted to prevent burning embers from being expelled from said portable fireplace;

means for selectively securing said one or more screen members to said portable fireplace;

a cover member supported above said screen members and spaced above said base member, said cover member being selectively removable from said screen members so as to provide access to said fire chamber when desired; and a support structure extending downwardly from said base member, said support structure adapted to support said base member above a support surface.

* * * * *